US006793589B1

(12) United States Patent
Yerelian

(10) Patent No.: US 6,793,589 B1
(45) Date of Patent: Sep. 21, 2004

(54) FLEXIBLE GOLF PUTTER

(76) Inventor: Minas Yerelian, 4422 W. Slauson Ave., Los Angeles, CA (US) 90043

( * ) Notice: Subject to any disclaimer, the term of this patent is extended or adjusted under 35 U.S.C. 154(b) by 0 days.

(21) Appl. No.: 10/354,559

(22) Filed: Jan. 31, 2003

(51) Int. Cl.[7] ..... A63B 53/14
(52) U.S. Cl. ..... 473/293; 473/294; 473/300
(58) Field of Search ..... 473/294, 300, 473/293

(56) References Cited

U.S. PATENT DOCUMENTS 5,328,185 A * 7/1994 Finnigan et al. ..... 473/294
5,374,064 A 12/1994 Barber ..... 273/194
5,439,219 A 8/1995 Vincent ..... 273/80
5,454,564 A 10/1995 Kronogard ..... 273/81.3
5,733,204 A 3/1998 Carrara ..... 473/300
5,842,930 A 12/1998 Koterba ..... 473/201
5,904,627 A 5/1999 Miyaji et al. ..... 473/319

* cited by examiner

*Primary Examiner*—Stephen Blau
(74) *Attorney, Agent, or Firm*—Goldstein Law Offices, P.C.

(57) ABSTRACT

A flexible golf putter for use in the game of golf when putting a golf ball into a hole. The construction of the putter serves to limit the amount of bodily movement necessary. By keeping the putter, golfer, and ball in one plane of motion, the precision of the putt is increased and the possibility of error is decreased. The flexible golf putter has a head portion, an elongated shaft portion, a top flexible grip portion mounted on the top end of the shaft portion, and a T-shaped appendage positioned between the shaft top end and bottom end. The appendage provides an additional handle for the putter and is used by the golfer to control movement of the golf ball.

5 Claims, 4 Drawing Sheets

FLEXIBLE GOLF PUTTER

BACKGROUND OF THE INVENTION

The invention relates to a flexible golf putter. In particular, the invention is a golf putter that has a flexible top end to aid in accurately hitting a golf ball towards a hole. Further, the putter has a T-shaped appendage that serves as an additional handle for the putter, said handle reducing stress on the user's wrist while helping to control the precision with which the golf ball is putted.

The game of golf is a popular sport and pastime for men and women of all ages. It is often difficult to excel at the game due to the high level of precision and accuracy necessary to complete a hole at or under par. Various clubs with different head sizes are utilized depending on how far the ball needs to be hit. When the golf ball is on the green, namely the area in the vicinity of the hole, a putter is typically chosen to hit the ball into the hole. A standard putter has a long thin head portion with a flat vertical surface for striking the ball, and a shaft that extends upward from the head portion. The design of the head portion facilitates controlled movement of the ball. The shaft serves as a handle for the putter, as well as enables the golfer to swing the putter to hit the ball. The length of the putter shaft is typically shorter than the other golf clubs in order to give the golfer better control over the ball. Since the putter is used when hitting the ball a short distance, it is important to have better precision. Thus, when putter, the golfer typically bends downward and holds the top end with both hands.

In addition, putters also exist that have a long shaft. When using this type of putter, the user places both hands on the shaft, towards the top end. The hands are situated slightly apart and must move in synchronicity in order to achieve a successful putt.

Putting a ball into the hole is properly achieved by performing a simple pendulum movement, whereby the putter is moved back and forth on a swing path that is perpendicular to the ground. The golfer usually stands on the side of the putter. It is important to keep the putter flat surface square to the target line throughout the putting action. The golfer's stance is extremely important throughout the golf game, particular during the putting movements. The golfer's feet are kept close together, with the weight of the body over the left foot slightly more than the right foot. During the swing, the feet should remain planted, while the upper body arches over the ball, thus maintaining the golfer's head directly over the target line. The arms should be kept slightly bent, with both arms kept close to the body while the shoulders are rotated to complete the swing. The golfer's eyes should remain on the ball, rather than looking to the hole. Because of the necessity of maintaining proper positioning of the body throughout the swing, it is extremely difficult to master the swing.

The shaft of the putter is typically attached to one end of the head portion, with the head portion oriented substantially perpendicular therefrom. The top end of the shaft, opposite the head portion, is called the "butt" of the shaft and is equipped with a grip portion. This portion is fully penetratable by the shaft. Thus, when putting, the golfer stands over the ball, holding the top end of the shaft, and positioning attachment point of the shaft on the head portion. It is often difficult for the golfer to keep the putter straight when swinging same. The end of the head portion opposite the shaft normally swings inward, thereby hitting the ball at an angle rather than straight on. Furthermore, since both arms need to move together during the golf swing, one hand normally acts as a guide and a balancer, while the second hand exerts the force to complete the swing or putt. When utilizing a putter with a long shaft, the hands are positioned further apart, thus making it more difficult to synchronize both hands during the putt.

Thus, there exists a need for a flexible golf putter that allows the golfer to maintain better control over the ball, thereby achieving greater accuracy when putting. Such a putter has a longer shaft than the typical putter with a T-shaped appendage positioned substantially perpendicular to the middle portion of the putter shaft. When putting, the golfer stands upright, and holds the top of the shaft with one hand and places his or her second hand over the appendage. Thus, the hand over the appendage is the only body part that needs to move during the swing. When putting, the golfer, the putter, and the golf ball remain in one plane of motion. Thus, when the putter is swung, it travels in the target line of the golf ball, movement of the putter controlled solely by the hand over the appendage. This limited movement decreasing the possibility of moving the rest of the body inaccurately and thereby ruining the putt.

U.S. Pat. No. 5,454,564 to Kronogard discloses a bent shaft putter for use in hitting a golf ball along an intended target line. U.S. Pat. No. 5,374,064 to Barber discloses a golf club training apparatus that essentially comprises a head assembly and a shaft assembly. The shaft assembly has a bent top end that is used to train a golfer. However, neither of these references incorporate a flexible grip portion, nor provide an additional handle for controlling the accuracy of the golf ball.

U.S. Pat. No. 5,439,219 to Vincent discloses a golf club shaft with optimized distribution of flexibility. The shaft has a tubular section wherein the degree of flexibility depends on the length of the shaft.

U.S. Pat. No. 5,733,204 to Carrara discloses a flex top putter grip wherein the golf club grip is constructed from a semi-rigid elastomeric material. The flexibility of the grip aids the golfer is perfecting a straight swing while moving horizontally or in one direction.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved flexible golf putter. As such, the general purpose of the present invention, which will be described subsequently in greater detail, is to provide a new and improved flexible golf putter which has all the advantages of the prior art and none of the disadvantages.

To attain this, the present invention essentially comprises a flexible golf putter for use in the game of golf when putting a golf ball into a hole. The construction of the putter serves to limit the amount of bodily movement necessary. By keeping the putter, golfer, and ball in one plane of motion, the precision of the putt is increased and the possibility of error is decreased. The flexible golf putter has a head portion, an elongated shaft portion, a top flexible grip portion mounted on the top end of the shaft portion, and a T-shaped appendage positioned between the shaft top end and bottom end. The appendage provides an additional handle for the putter and is used by the golfer to control movement of the golf ball.

It is an object of the invention to produce a flexible golf putter that improves a golfer's accuracy when putting a golf ball towards a hole. Accordingly, the putter has a T-shaped appendage attached to the shaft, said appendage providing an additional handle for guiding the golf ball along the intended target line. When putting, the golfer stands along the target line and swings the putter forward towards the hole.

It is a further object of the invention to produce a flexible golf putter that may be utilized by a right-handed or left-handed golfer. Accordingly, since the golfer and the putter are both positioned within one plane of motion, the golfer may use either hand to hit and guide the golf ball towards the hole.

It is a still further objection of the invention to produce a flexible golf putter that reduces the amount of strain on a golfer's wrist. Accordingly, when putting with the flexible golf putter, it is not necessary to swing the golf club, thereby eliminating movement of the wrist. The golfer merely moves the club forward to make contact with the ball. It is not necessary for both hands to move in a synchronized motion in order to accomplish a complete and accurate putting stroke.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

Figure 1:
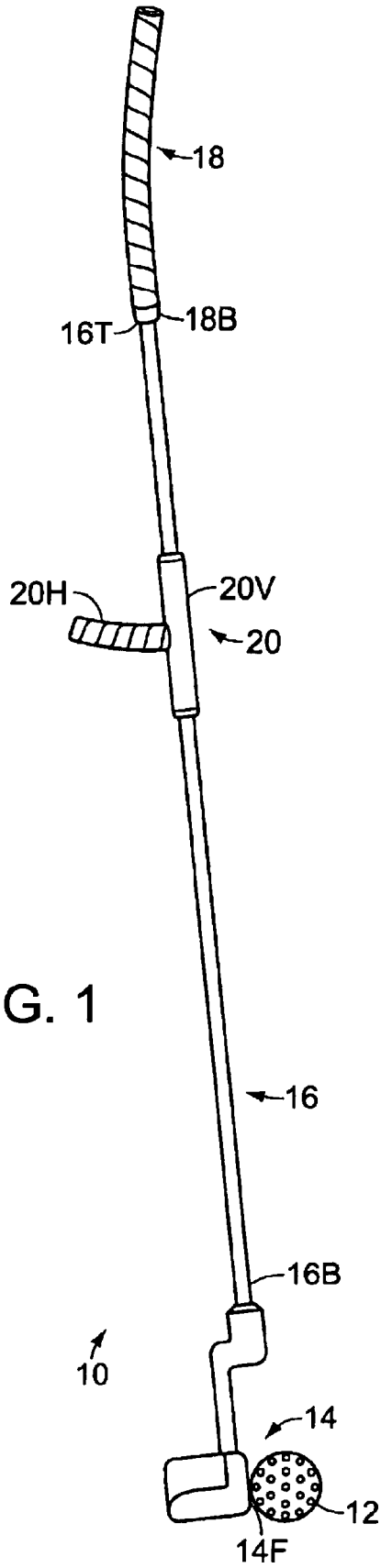
FIG. 1 is a front elevational view of the flexible golf putter, with a golf ball in contact with the putter head portion.

| REFERENCE NUMERALS | |
|---|---|
| 10 | flexible golf putter |
| 12 | golf ball |
| 14 | head portion |
| 14F | head portion front surface |
| 16 | shaft portion |
| 16T | shaft portion top end |
| 16B | shaft portion bottom end |
| 18 | top flexible grip portion |
| 18B | to flexible grip portion bottom end |

-continued

| REFERENCE NUMERALS | |
|---|---|
| 20 | T-shaped appendage |
| 20H | T-shaped appendage horizontal portion |
| 20V | T-shaped appendage vertical portion |
| 22 | hollow portion |
| 24 | spring |

DETAILED DESCRIPTION OF THE PREFERRED EMBODIMENTS

FIG. 1 illustrates a flexible golf putter 10 for use in the game of golf, particularly in putting a golf ball 12 into a hole. The construction of the golf putter 10 allows a golfer to maintain better control over the golf ball 12 and achieve greater accuracy when putting by placing the golfer, the putter 10, and the golf ball 12 in one plane of motion. The putter 10 serves to limit the amount of bodily movement necessary, thereby increasing the precision of the putt and decreasing the possibility of error. The flexible golf putter 10 essentially comprises a head portion 14, an elongated shaft portion 16, a top flexible grip portion 18 affixed to the shaft portion 16, and a T-shaped appendage 20.

The flexible golf putter 10 has a longer shaft portion 16 than the average golf putter shaft. In particular, referring to FIG. 6, the shaft portion 16 is constructed to extend up to a golfer's chest region, whereas an average golf putter shaft extends only up to the golfer's waist. This added length increases the control over the putter 10.

Figure 2:
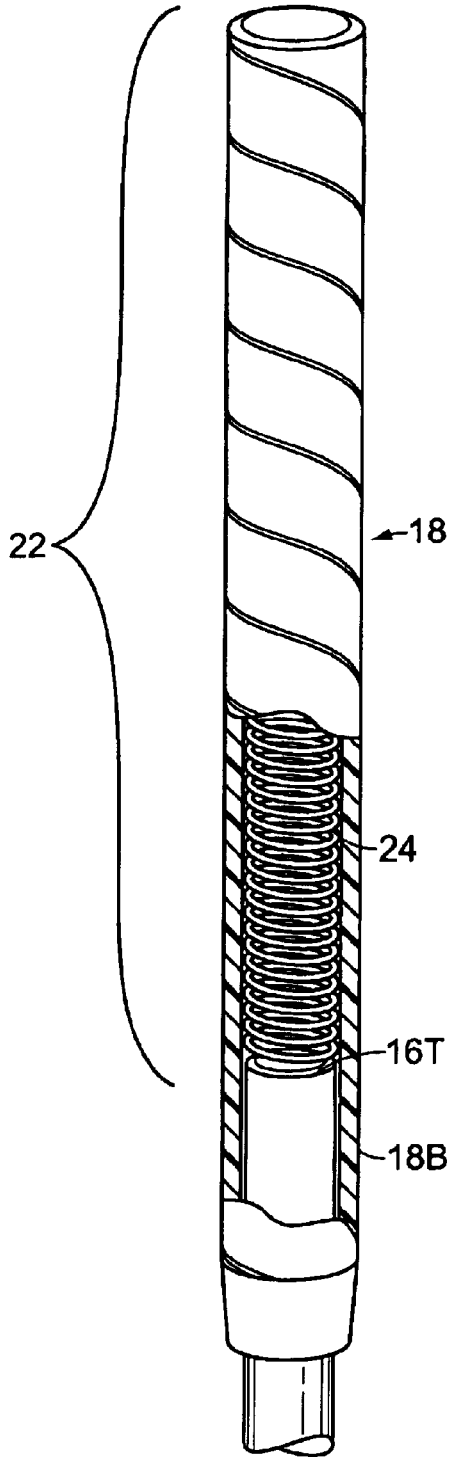
FIG. 2 is an enlarged view of the top end of the golf putter shaft portion and the top flexible grip portion, with a portion of the grip broken away to illustrate the hollow portion.
Figure 3:
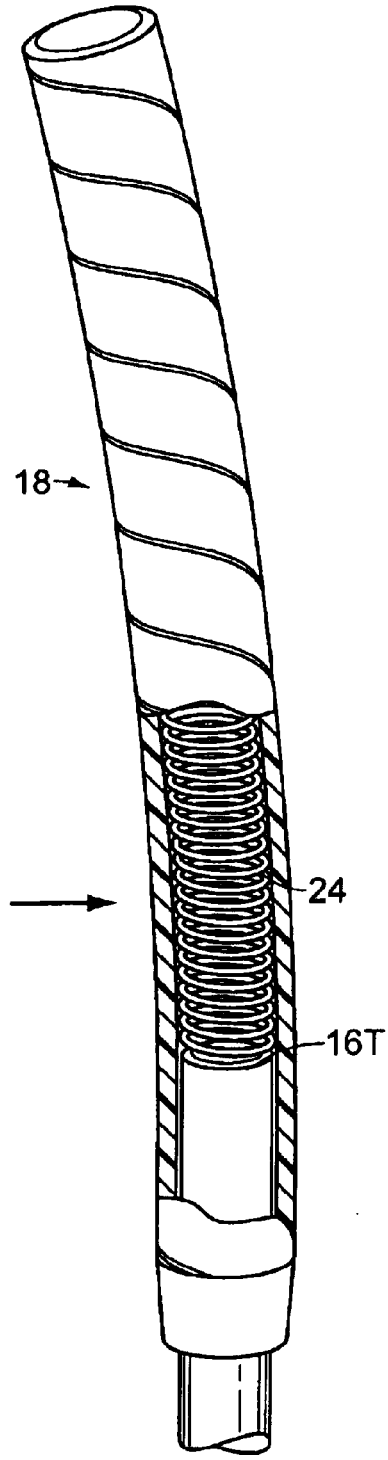
FIG. 3 is an enlarged view of the top end of the golf putter shaft portion and the top flexible grip portion, with a portion of the grip broken away, illustrating the flexibility of the grip portion.

The shaft portion 16 has a top end 16T and a bottom end 16B, wherein the putter head portion 14 is attached to the shaft bottom end 16B. The shaft top end 16T has a top flexible grip portion 18 attached therearound, said grip 18 facilitating handling of the putter 10. The grip portion 18 has an open bottom end 18B that mates with the shaft top end 16T, said shaft 16 extending a portion of the way upward into the grip portion 18. The grip portion 18 further has a hollow portion 22 above the shaft top end 16T which is extremely flexible and bends to allow the shaft 16 to swing when the user grasps said hollow portion 22. A spring 24 may be positioned within the hollow portion 22, said spring 24 allowing for flexibility of the top flexible grip portion 18 while providing stability for the shaft 16, as illustrated in FIG. 2. This flexible grip portion 16 is utilized in stabilizing the golf putter 10 during use. In use, the hollow portion 22 of the flexible grip portion 18 allows the remainder of the shaft portion 16 to move independently from the grip portion 18.

Figure 4:
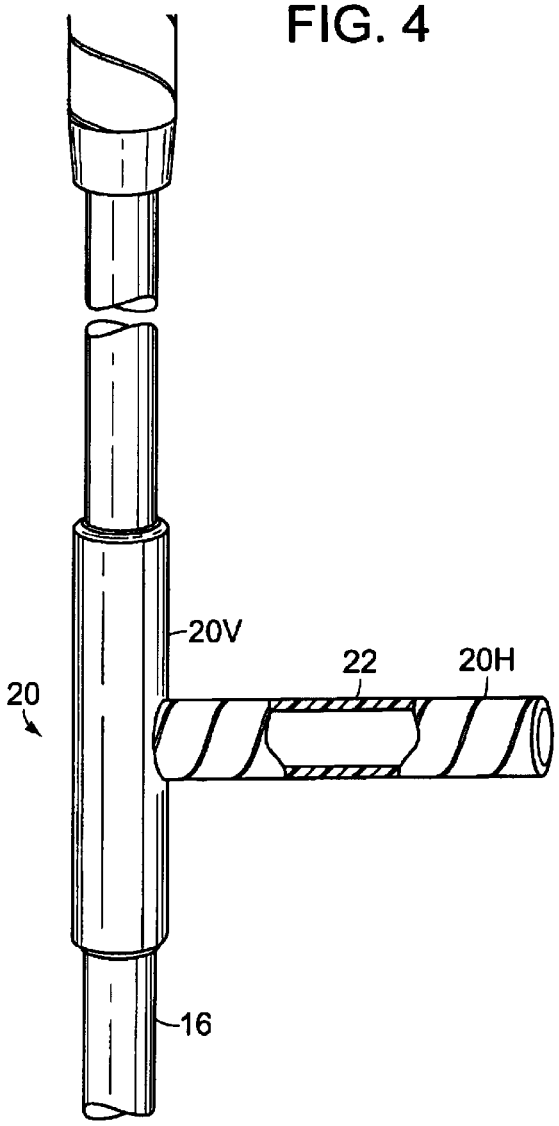
FIG. 4 is an enlarged view of the golf putter T-shaped appendage, with a portion of the horizontal portion broken away to illustrate the hollow interior.
Figure 5:
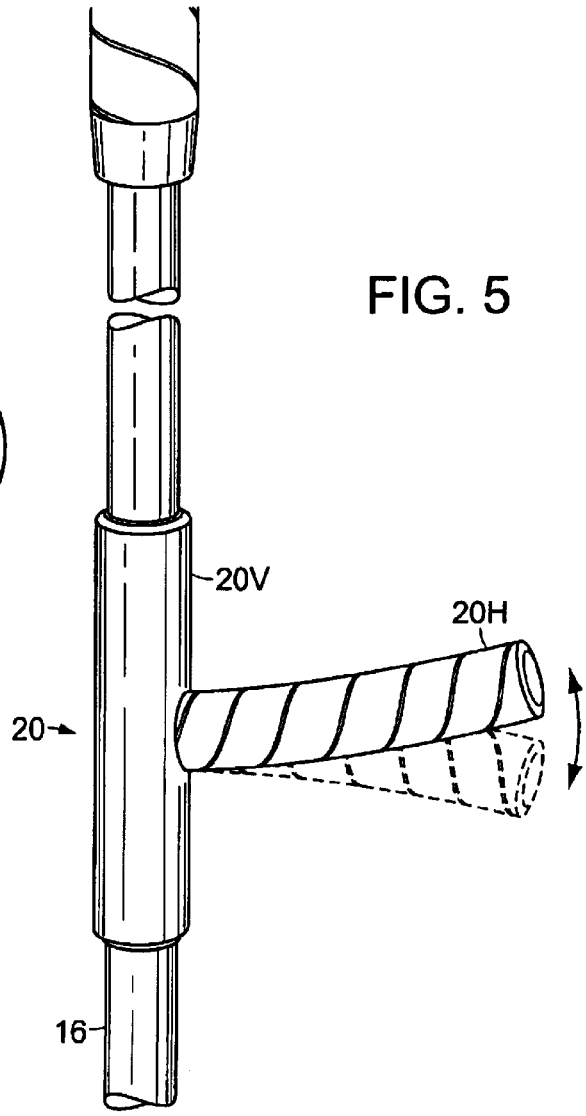
FIG. 5 is an enlarged view of the golf putter T-shaped appendage, illustrating the flexibility of the horizontal portion.

Referring to FIG. 4, the T-shaped appendage 20 is positioned along the shaft portion 16, between the top end 16T and the bottom end 16B. The appendage 20 comprises a vertical sleeve 20V and a horizontal portion 20H, wherein the vertical sleeve 20V is secured around the shaft 16 and the horizontal portion 20H extends substantially perpendicular to the vertical sleeve 20V, as well as the shaft 16. Both the vertical sleeve 20V and the horizontal portion 20H of the appendage are hollow. Thus, the vertical sleeve 20V accommodates the shaft 16, and the horizontal portion 20H has a large degree of flexibility, as illustrated in FIG. 5. This T-shaped appendage is used as an additional handle and guide when putting the golf ball 12 towards the hole. Further, the horizontal portion 20H may be constructed from rubber to facilitate its flexibility.

The golf putter head portion 14, secured to the bottom end 16B of the shaft 16, has a substantially flat front surface 14F.

When putting, the flat front surface 14F comes into direct contact with the golf ball 12 and hits said ball 12 towards the hole.

Figure 6:
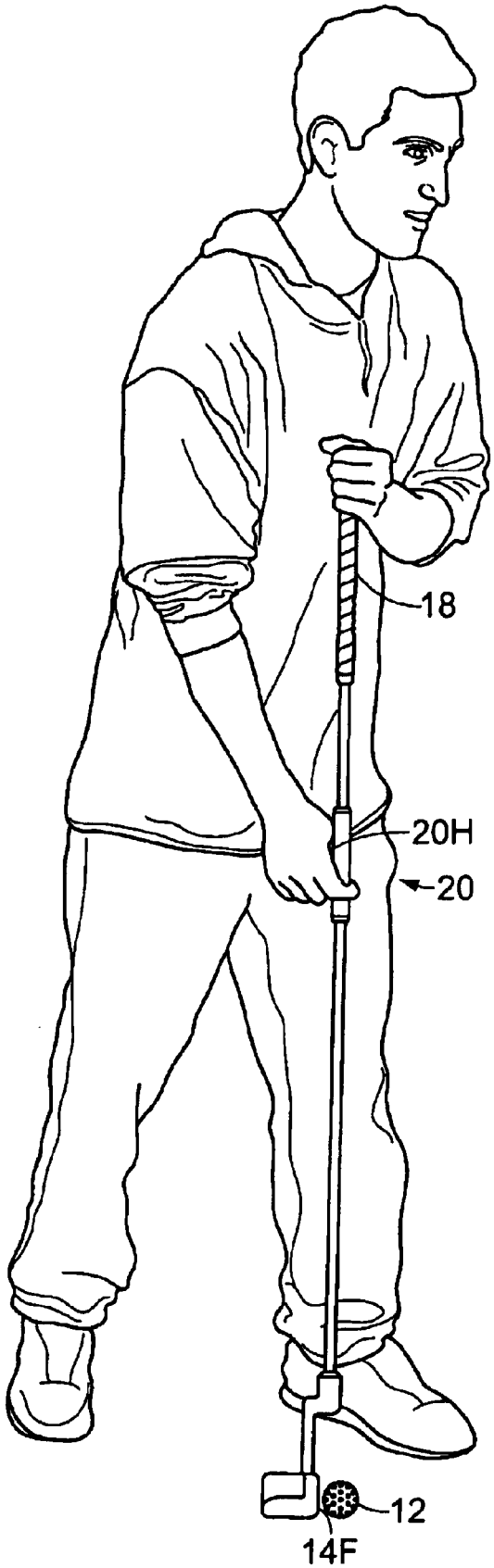
FIG. 6 is a perspective view of the flexible golf putter in use by a golfer.

In use, the golfer positions the putter 10 in front of the golfer's body, with the appendage horizontal portion 20H directed inward towards the golfer. As illustrated in FIG. 6, the golfer then grasps the top flexible grip portion 18 with one hand and grasps the T-shaped appendage horizontal portion 20H with his or her other hand. The head portion front surface 14F is then aligned with the golf ball 12. When putting the golf ball 12 towards the hole, the golfer needs only move the hand grasping the appendage 20. The remainder of the golfer's body remains motionless, thereby preventing errors that would affect the travel line of the golf ball 12. The golfer may place either hand around the appendage 20, depending on whether he or she is right-handed or left-handed.

In conclusion, herein is presented a flexible golf putter. The invention is illustrated by example in the drawing figures, and throughout the written description. It should be understood that numerous variations are possible, while adhering to the inventive concept. Such variations are contemplated as being a part of the present invention.

What is claimed is:

1. A flexible golf putter for hitting a golf ball into a hole during a game of golf, comprising:

an elongated shaft portion, the shaft portion having a top end and a bottom end;

a top flexible grip portion having an open bottom end, the grip portion mounted at the top end of the shaft, the open bottom end partially penetrated by the shaft portion creating a hollow portion extending above the shaft portion top end, the open bottom end closely accommodates the shaft portion top end;

a head portion, the head portion secured to the shaft portion bottom end, said head portion having a flat front surface for hitting the golf ball; and a transverse appendage, the appendage positioned along the shaft portion between the shaft top end and the shaft bottom end and extending substantially perpendicular to the shaft portion.

2. The flexible golf putter as recited in claim 1, wherein the appendage is T-shaped, having a vertical sleeve and a horizontal portion, the vertical sleeve being secured around the shaft and the horizontal portion extending substantially perpendicular to the vertical sleeve and the shaft.

3. The flexible golf putter as recited in claim 2, wherein the appendage vertical sleeve and horizontal portion are each hollow, such that the vertical sleeve accommodates the shaft, and the horizontal portion is flexible.

4. The flexible golf putter as recited in claim 3, wherein the appendage horizontal portion is constructed from rubber.

5. A method of putting a golf ball into a hole using a flexible golf putter, the flexible golf putter comprising a shaft portion having a top end and a bottom end, a flexible grip portion mounted on the shaft top end, the flexible grip portion having a hollow portion located above the top end of the shaft, a head portion having a flat front surface, and an appendage having a horizontal portion and a vertical sleeve secured around the shaft, comprising the steps of:

a) positioning the golf putter in front of the golfer, with the appendage horizontal portion pointed inward towards the golfer;

b) placing the golf ball adjacent to the head portion flat front surface;

c) holding the golf putter by grasping the hollow portion of the flexible grip portion with one hand and grasping the appendage horizontal portion with the other hand;

d) hitting the ball towards the hole by pushing the putter forwardly away from the golfer by pushing the hand grasping the appendage horizontal portion away from the golfer and towards the golf ball; and e) repeating steps (a) to (d) until the ball is hit into the designated hole.

* * * * *